US007763213B2

(12) United States Patent
Miksic et al.

(10) Patent No.: US 7,763,213 B2
(45) Date of Patent: Jul. 27, 2010

(54) VOLATILE CORROSION INHIBITOR PACKAGES

(75) Inventors: Boris A. Miksic, North Oaks, MN (US); Cliff Cracauer, Oakdale, MN (US); Brian Wuertz, Fridley, MN (US); Scott Bolton, Austin, TX (US); Barry Haygood, Austin, TX (US); Grant McEwan, Austin, TX (US)

(73) Assignees: Freescale Semiconductor, Inc., Austin, TX (US); Cortec Corporation, St. Paul, MN (US)

( * ) Notice: Subject to any disclaimer, the term of this patent is extended or adjusted under 35 U.S.C. 154(b) by 1160 days.

(21) Appl. No.: 11/314,220

(22) Filed: Dec. 21, 2005

(65) Prior Publication Data

US 2007/0138031 A1 Jun. 21, 2007

(51) Int. Cl.

| | |
|---|---|
| ***A61L 9/00*** | (2006.01) |
| ***A62B 7/08*** | (2006.01) |
| ***B65D 81/24*** | (2006.01) |
| ***C09K 3/00*** | (2006.01) |
| ***A21D 10/02*** | (2006.01) |
| ***B32B 3/12*** | (2006.01) |
| ***B32B 27/00*** | (2006.01) |
| ***B32B 5/18*** | (2006.01) |
| ***B32B 27/04*** | (2006.01) |
| ***B32B 27/12*** | (2006.01) |
| ***A01M 13/00*** | (2006.01) |
| ***B65B 41/18*** | (2006.01) |

(52) U.S. Cl. ..... 422/123; 422/1; 422/5; 422/28; 422/305; 206/205; 252/194; 426/118; 428/425.5; 428/424.7; 428/118; 442/118; 442/76; 442/131; 442/286; 442/268; 43/124; 43/125; 53/425; 53/170; 53/562; 53/285; 53/381.1; 53/393; 53/452

(58) Field of Classification Search ..... 442/1, 442/5, 28, 123, 305, 118, 76, 131, 286, 268; 206/205; 252/194; 426/118; 428/425.5, 428/424.7, 118; 422/1, 5, 28, 123, 305; 43/124–125; 53/425, 170, 562, 285, 381.1, 393, 452
See application file for complete search history.

(56) References Cited

U.S. PATENT DOCUMENTS

| | | | | |
|---|---|---|---|---|
| 4,597,218 | A * | 7/1986 | Friemel et al. | 43/131 |
| 4,973,448 | A | 11/1990 | Carlson et al. | |
| 5,139,700 | A | 8/1992 | Miksic et al. | |
| 5,209,869 | A | 5/1993 | Miksic et al. | |
| 5,332,525 | A | 7/1994 | Miksic et al. | |
| 5,378,428 | A * | 1/1995 | Inoue et al. | 422/9 |
| 5,422,187 | A * | 6/1995 | Miksic et al. | 428/545 |

(Continued)

OTHER PUBLICATIONS

International Search report for corresponding PCT Application No. PCT/US06/62292 dated Sep. 28, 2007.

*Primary Examiner*—Jill Warden
*Assistant Examiner*—Monzer R Chorbaji

(57) ABSTRACT

A package for enclosing volatile corrosion inhibiting materials includes a first enclosure barrier being fabricated from one or more gas-impermeable materials and defining a first enclosed space. The package further includes a substrate having one or more volatile corrosion inhibitor materials disposed thereon, with the substrate being disposed within the first enclosed space. In some embodiments, a second enclosure barrier being fabricated from a gas-permeable, solid particle-impermeable material is disposed in the first enclosed space, and defines a second enclosed space inside of the first enclosed space. In such embodiments, the substrate is preferably disposed within the second enclosed space.

26 Claims, 4 Drawing Sheets

U.S. PATENT DOCUMENTS

| | | | |
|---|---|---|---|
| 5,545,289 | A | 8/1996 | Chen et al. |
| 6,028,160 | A | 2/2000 | Chandler et al. |
| 6,080,334 | A | 6/2000 | Heimann et al. |
| 6,146,730 | A | 11/2000 | Lewis et al. |
| 6,551,552 | B1 | 4/2003 | Lyublinski et al. |
| 6,617,415 | B1 | 9/2003 | Miksic et al. |

* cited by examiner

VOLATILE CORROSION INHIBITOR PACKAGES

FIELD OF THE INVENTION

The present invention relates to packages enclosing volatile corrosion inhibitor-containing materials generally, and more particularly to packaging incorporating an outer gas-impermeable barrier and an inner gas-permeable, solid particle-impermeable barrier within which a volatile corrosion inhibitor-containing substrate is contained.

BACKGROUND OF THE INVENTION

Volatile corrosion inhibitor materials, such as vapor phase corrosion inhibitors, are widely utilized as species impregnated within or otherwise disposed upon various substrates. The volatile corrosion inhibitor (VCI) materials emit vapor phase corrosion inhibitors over time, even at ambient conditions, such that by placing the VCI-containing substrate at a location adjacent to corrosion-susceptible materials, the vapor phase corrosion inhibitors operably act to protect such materials from corrosion.

In some embodiments of the prior art, volatile corrosion inhibitor materials have been incorporated into films for use as barrier layers to enclose corrosion-susceptible items. In such embodiments, vapor phase corrosion inhibitors are released from the barrier film to engage with the enclosed item so as to protect the item from corrosion.

In other embodiments of the prior art, volatile corrosion inhibitor materials have been incorporated with a substrate to form a corrosion inhibiting product that may be placed adjacent to corrosion-susceptible items. A wide variety of substrates in a wide variety of configurations are useful in releasably containing the volatile corrosion inhibitor materials, with such substrates being fabricated from, for example, nonwoven fabrics, paper, polymeric films, and foam materials, such as open cell urethane foams. In certain applications, adhesives may be applied to a surface of the substrate, such that the corrosion inhibiting product may be adhesively affixed to a location adjacent to the targeted corrosion-susceptible items.

It has been found that such corrosion inhibiting products may be disposed within a permeable enclosure that allows the vapor phase corrosion inhibitor to be emitted out from within the enclosure to protect adjacent corrosion-susceptible items. An example permeable enclosure for volatile corrosion inhibitor materials is described in U.S. Pat. No. 5,422,187, which is incorporated herein by reference. The permeable enclosure barrier described in U.S. Pat. No. 5,422,187 allows vapors to pass therethrough but prevents emission of solid particles out from the enclosure.

A particular application for corrosion inhibitor products contained within a gas-permeable enclosure is in the fabrication of semiconductors and related electronic components. Such components are typically manufactured in "clean room" environments so as to prevent contamination during the manufacturing process. In addition to attempting to prevent particle contamination of such electronic components, manufacturers have also taken steps to minimize exposure to moisture and other airborne chemical contaminates, which can partially corrode delicate metal elements in the electronic devices. One measure commonly taken is to limit the time of exposure to the clean room environment between processing steps which expose metal surfaces of the electronic device. These queue times in conjunction with ambient moisture controls are used to successfully process semiconductor devices without incurring corrosion of metallic features.

It has been found that volatile corrosion inhibitor products can assist in preventing corrosion damage to such electronic components by placing the corrosion inhibiting products in proximity to the electronic components to thereby expose such components to vapor phase corrosion inhibitors. To eliminate the risk of particle contamination of the electronic components, from, for example, degradation of the corrosion inhibitor product or emission of solid volatile corrosion inhibitors, the corrosion inhibitor products are preferably enclosed within a gas-permeable, solid particle-impermeable barrier.

In researching the effectiveness of currently available gas-permeable barrier enclosed corrosion inhibitor products, Applicants have determined that a relatively high concentration of vapor phase corrosion inhibitors present in a treatment zone is desired for insuring corrosion protection of the electronic components stored therein. However, due to the volatile nature of the corrosion inhibitor materials in the corrosion inhibitor products, the effectiveness of such corrosion inhibitor products decreases over time when exposed to ambient conditions as a result of vapor pressure equilibration effects. In the course of experimentation and testing, it has now been discovered that corrosion inhibitor products disposed in gas-permeable barriers alone have the tendency to lose effectiveness over time.

In addition, it has been found that the release rate of vapor phase corrosion inhibitors from the corrosion inhibiting products is limited by the total surface area of the supporting substrate that is capable of emitting vapor phase corrosion inhibitors to the ambient surroundings.

Accordingly, it is a principal object of the present invention to provide a volatile corrosion inhibitor package that incorporates a gas-impermeable outer enclosure barrier that maintains a desired elevated corrosion inhibitor vapor pressure adjacent to the corrosion inhibitor product.

It is a further object of the present invention to provide a volatile corrosion inhibitor package that incorporates an outer gas-impermeable barrier layer and a gas-permeable, solid particle-impermeable inner barrier layer within which a corrosion inhibitor product is disposed until it is ready for use.

It is a still further object of the present invention to provide a corrosion inhibitor product having an enhanced emission surface area for accelerating release of vapor

DETAILED DESCRIPTION OF THE PREFERRED EMBODIMENTS

The objects and advantages enumerated above together with other objects, features, and advances represented by the present invention will now be presented in terms of detailed embodiments described with reference to the attached drawing figures which are intended to be representative of various possible configurations of the invention. Other embodiments and aspects of the invention are recognized as being within the grasp of those having ordinary skill in the art.

Figure 1:
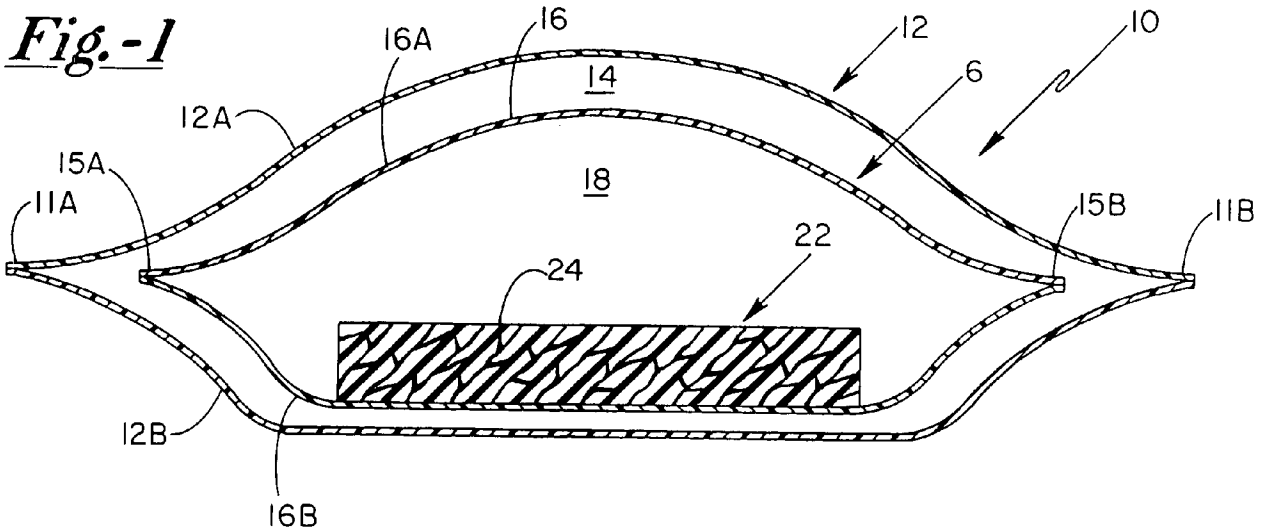
FIG. 1 is a cross-sectional side view of a corrosion inhibitor package of the present invention.

With reference now to the drawing figures, and first to FIG. 1, a vapor phase corrosion inhibiting package 10 includes a first enclosure barrier 12 defining a first enclosed space 14, a second enclosure barrier 16 disposed in first enclosed space 14, and itself defining a second enclosed space 18 therewithin. Corrosion inhibiting package 10 preferably further includes a substrate 22 disposed within second enclosed space 18, with substrate 22 including volatile corrosion inhibitor materials disposed thereon and therein.

First enclosure barrier 12 is preferably fabricated from a gas-impermeable material that both prevents moisture or other vapor phase materials from penetrating into first enclosed space 14, and prevents vapor phase corrosion inhibitor materials emitted from substrate 22 from passing therethrough. In preferred embodiments, therefore, first enclosure barrier 12 is fabricated from a gas-impermeable material such as a metallized film. Such metallized films may also include metallized film laminates. A particular example of a material useful in first enclosure barrier 12 is polyethylene terephthalate film containing a vapor deposited film or layer of metallic aluminum. Such films are commercially available and are commonly designated as "metallized" films.

Preferably, first enclosure barrier 12 is formed by sealing together two distinct film layers 12A, 12B at perimeter sealing edges 11A, 11B. Conventional sealing mechanisms may be employed for obtaining a gas-tight seal at the perimeter seal edge 11A, 11B, with such sealing techniques including, for example, heat-sealing, ultra-sonic sealing, and the like. Preferably, second enclosure barrier 16 and substrate 22 are placed upon a respective inner surface of one or both of first and second film layers 12A, 12B prior to the sealing process.

In other embodiments, however, first enclosure barrier 12 may be formed of a single film layer operably secured and sealed to a base layer, with both layers being gas-impermeable materials. By way of example, first metallized film layer 12A may be secured to an aluminum plate (not shown) for sealably enclosing second enclosure barrier 16 and substrate 22. While the present invention contemplates a variety of materials and methods for obtaining first enclosure barrier 12, it is a principle object of the invention to obtain a gas-impermeable barrier within which second enclosure barrier 16 and substrate 22 are operably disposed. Moreover, first enclosure barrier 12 is preferably configured so as to be openable by the user, such that the user may operably position corrosion inhibitor product 6, which is the combination of second enclosure barrier 16 and substrate 22, at desired locations for effecting a vapor phase corrosion inhibition characteristic. Specifically, first enclosure barrier 12 is preferably configured to only temporarily contain corrosion inhibitor product 6, such that when the user desires the release of vapor phase corrosion inhibitors from corrosion inhibitor product 6, such user may operably remove corrosion inhibitor product 6 from within first enclosure barrier 12.

Accordingly, first enclosure barrier 12 acts to maintain an environment in first enclosed space 14 having an elevated vapor pressure for the volatile corrosion inhibitors disposed on and in substrate 22. In such an environment, an equilibrated vapor pressure between an outer surface 24 of substrate 22 and first and second enclosed space 14, 18 is quickly achieved. The rapid equilibration of vapor pressures results in a retention and equilibrium by substrate 22 of the volatile corrosion inhibitor material originally disposed thereat. Such a characteristic leads to a relatively "fresh" corrosion inhibitor product 6 at the ultimate point of use, which could be several days or months subsequent to original product manufacture. In other words, corrosion inhibitor product 6 is prevented from emitting a substantial portion of the volatile corrosion inhibitor materials originally incorporated into substrate 22 prior to the time at which the user removes corrosion inhibitor product 6 from within first enclosed space 14.

Second enclosure barrier 16 is preferably a gas-permeable, but solid particle-impermeable material that provides for the emission of vapor phase corrosion inhibitors therethrough. However, the material making up second enclosure barrier 16 prevents solid particles from passing therethrough, thereby preventing solid particle contamination of the environment external to second enclosure barrier 16.

Although a variety of clean-room approved, gas-permeable fabrics are envisioned for use in the second enclosure barrier 16 of the present invention, exemplary preferred materials include Tyvek® 1059 which is available from E.I. du Pont de Nemours and Company under the "Tyvek®" class of materials, and those available from W.L. Gore, Inc. under the trade name "Goretex®". In a further aspect of the invention, use of the above-cited materials provides mono-direction emissivity, such that vapors are only allowed to pass through second enclosure barrier 16 from within second enclosed space 18. As such, water vapor and other vapor-borne contaminants are prevented from entering second enclosed space 18. Such a characteristic is important to the longevity of the present invention, in that certain vapor substances have been found to degrade substrate 22 and otherwise limit the effectiveness of corrosion inhibitor product 6.

As shown in FIG. 1, second enclosure barrier 16 is preferably formed of two distinct film layers 16A, 16B, and sealed together through conventional sealing techniques at perimeter sealing edges 15A, 15B. Second enclosure barrier 16 may be formed of homogeneous or heterogeneous films. In one embodiment, for example, first film layer 16A may be fabricated from a 0.125-0.175 mm caliper thickness Tyvek® fabric, while second film layer 16B may be fabricated from different materials, such as polyethylene having a caliper thickness of about 0.05-10 mm. Such a heterogeneous configuration for second enclosure barrier 16 reduces material costs in that Tyvek® material is substantially more expensive than more commonly utilized polymeric films, and enhances the overall durability of corrosion inhibitor product 6. Such durability may be further enhanced by creating second film layer 16B of a relatively durable polymeric material such as polyethylene. In such an embodiment, only a portion of second enclosure barrier 16 is fabricated from a relatively thin layer of e.g. Tyvek®.

Of course, since at least a portion of second enclosure barrier 16 is fabricated from a gas-permeable material, first and second enclosed spaces 14, 18 are in at least gaseous communication with one another. As a result, the vapor pressures of the respective volatile corrosion inhibitor material is in operable equilibrium with one another. By minimizing the volume of first enclosed space 14 external to second enclosure barrier 16, reduction in vapor phase corrosion inhibitor potential, as measured from an original "charge" of material at manufacture, is minimized.

As indicated above, substrate 22 is preferably disposed in second enclosed space 18, and may be either freely disposed therein, or may alternatively be adhered to a respective inner surface of second enclosure barrier 16. Although substrate 22 may be any of a variety of materials and configurations useful in at least temporarily retaining volatile corrosion inhibitor material thereat, a particularly preferred material for use in corrosion inhibitor product 6 of the present invention is an open cell isocyanate-derived or urethane foam. Materials and methods for impregnating or otherwise incorporating volatile corrosion inhibitor material within substrate 22 are described in, for example, U.S. Pat. No. 5,422,187. As described therein, open cell foam substrate 22 is preferably impregnated with volatile corrosion inhibitor material by immersing substrate 22 in a liquid solution containing the volatile corrosion inhibitor material. Subsequent evaporation of the solvent from substrate 22 yields an impregnated foam product. Various ratios of ingredients may be impregnated in substrate 22, with certain volatile corrosion inhibitor material being useful for the particular corrosion-susceptible materials in need of corrosion protection.

Other methods and materials for obtaining substrate 22, however, are contemplated by the present invention. For example, a porous paper or non-woven fabric may be impregnated with volatile corrosion inhibitor material in solid or liquid form.

In certain applications of the present invention, such as in the corrosion protection semiconductor wafers, it has been found that substrate 22 is most useful in a configuration forming a planar surface that is placed within close proximity to the surface of exposed metal features of the semiconductor wafers. Preferably, such proximity is between about 2 and 10 mm. Such a wafer to substrate orientation may be achieved within an enclosed environment such as a lot box or other container to hold a plurality of semiconductor wafers in the presence of one or more corrosion inhibitor-containing substrates for a defined period of time to deposit a protective corrosion inhibitor layer upon the semiconductor wafers.

In preferred embodiments of the present invention, substrate 22 contains between about 35 and 60% by weight volatile corrosion inhibitor material. In embodiments utilizing open cell foam as the material for substrate 22, the volatile corrosion inhibitor materials are preferably present at between 40% and 65% by volume of the total substrate volume, depending upon the density of the foam construction. Such concentrations of volatile corrosion inhibitor material have been found to provide a desired level of corrosion protection upon adjacent corrosion-susceptible items, and particularly for electronic components disposed in a conventionally arranged lot box.

Figure 2:
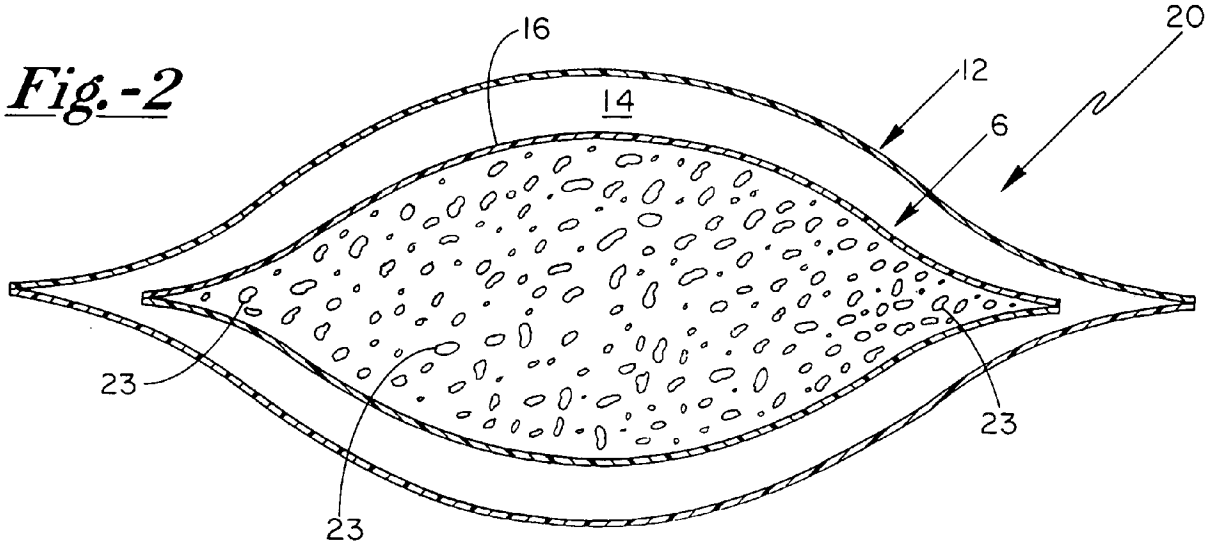
FIG. 2 is a cross-sectional side view of a corrosion inhibitor package of the present invention.

As shown in FIG. 2, a further embodiment of the present invention is provided wherein substrate 23 of corrosion inhibiting package 20 is in the form of ground pieces of substrate 22. As such, substrate 23 is in the form of a plurality of distinct pieces having a mean diameter of between about 0.25 and about 0.5 mm. Most preferably, substrate 23 is in the form of a plurality of distinct open cell foam pieces, with the average loading of volatile corrosion inhibitor material in the substrate pieces 23 being between about 35 and 60% by weight.

As described above, one aspect of the present invention is in the rapid disbursement of vapor phase corrosion inhibitor once corrosion inhibitor package 6 is removed from first enclosure barrier 12. The embodiment of substrate 23 illustrated in FIG. 2 enables such a rapid dispersion by significantly increasing the surface area of loaded substrate 23 exposed to the ambient environment once corrosion inhibitor product 6 is removed from first enclosure barrier 12. The embodiment of substrate 23 in the form of a plurality of distinct foam pieces provides several magnitudes greater total VCI release surface area.

Figure 3:
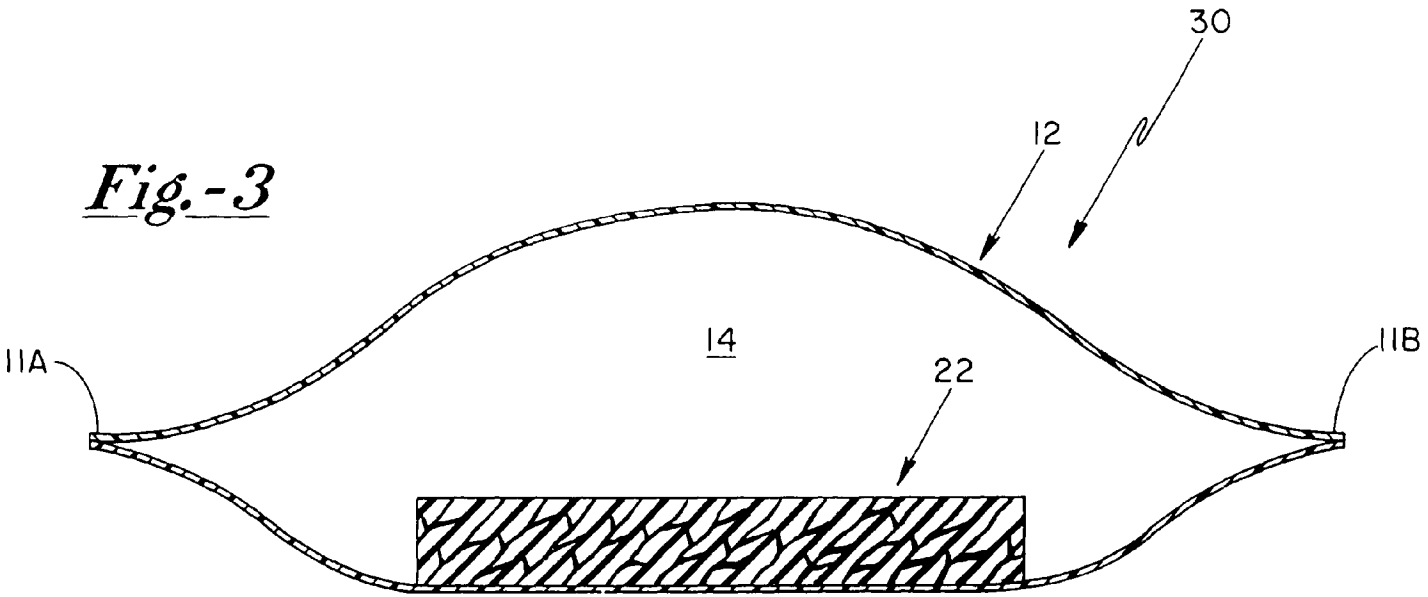
FIG. 3 is a cross-sectional side view of a corrosion inhibitor package of the present invention.

An additional embodiment of the present invention is illustrated in FIG. 3, wherein substrate 22 is disposed within first enclosed space 14 defined by first enclosure barrier 12. Thus, vapor phase corrosion inhibiting package 30 enables the containment of volatile corrosion inhibitors within enclosed space 14 without the utilization of second enclosure barrier 16.

Figure 4:
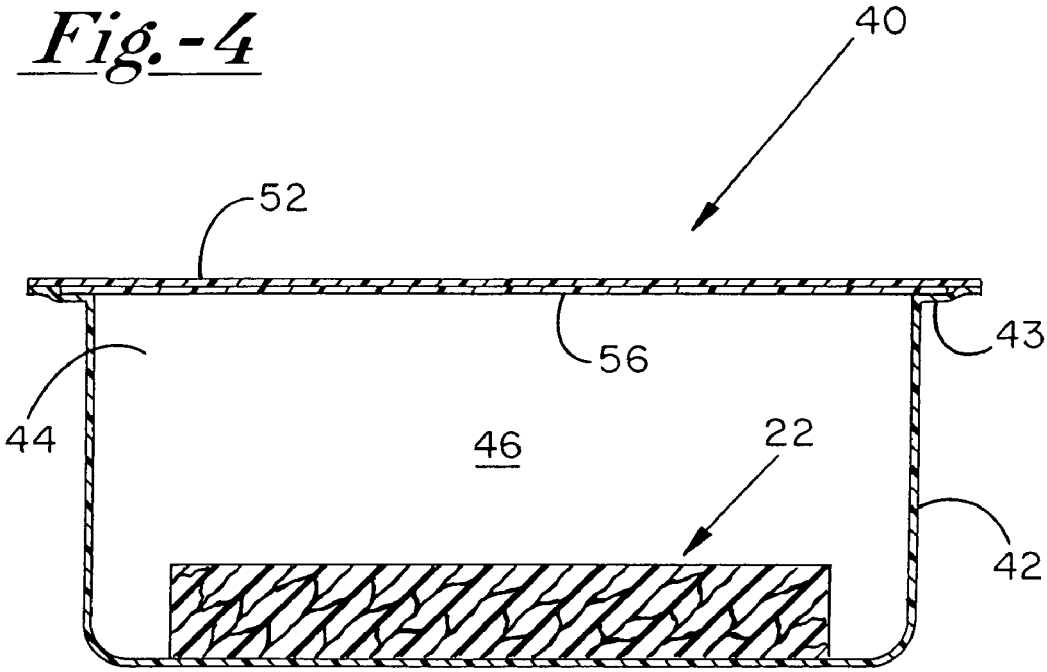
FIG. 4 is a cross-sectional side view of a corrosion inhibitor package of the present invention.

A further embodiment of the corrosion inhibiting package of the present invention is illustrated in FIG. 4, wherein package 40 includes a structure 42 having a first open end 44 defining a chamber 46 in communication with first open end 44. Structure 42 is preferably fabricated from a gas-impermeable material such as polyethylene. In preferred embodiments, structure 42 has a wall thickness sufficiently large so as to render structure 42 self-supporting in a pre-defined configuration. As such, the wall thickness of structure 42 is preferably between about 0.25 and 10 mm, and more preferably between about 0.5 and 2 mm.

A first barrier layer 56 is preferably disposed at and encloses first open end 44 of structure 42. In preferred embodiments, first barrier layer 56 is secured to annular flange 43 of structure 42 through heat sealing, ultrasonic bonding, adhesive bonding, or other conventional bonding techniques. First barrier layer 56 is preferably a gas-permeable, solid particle-impermeable material, as described above.

Package 40 preferably further includes a second barrier layer 52 superimposed over first barrier layer 56, and secured to structure 42, such as at annular flange 43 of structure 42. Second barrier layer 52 is preferably secured to structure 42 through well known techniques, such as those described above. Second barrier layer 52 is preferably fabricated from a gas-impermeable material and is preferably positioned at package 40 so as to enclose first barrier layer 56 within a first enclosure defined by structure 42 and second barrier layer 52. Such an enclosure is therefore gas-impermeable so as to rapidly equilibrize the vapor pressure of corrosion inhibiting materials, as between chamber 46 and substrate 22. Such an enclosure thereby inhibits the degradation of corrosion inhibiting effectiveness over time of substrate 22.

In accordance with a preferred embodiment of the present invention, package 40 of the present invention may be utilized by breaching second barrier layer 52 through penetration thereof or some other fashion in order to render chamber 44 in gas communication with the ambient environment external to package 40. Such breaching may be accomplished by, for example, creating one or more apertures in second barrier layer 52 with a piercing object, removing portions of second barrier layer 52 sufficient to enable vapor transfer between chamber 46 and the ambient environment external to structure 42, and/or removal of second barrier layer 52 substantially in its entirety. Once such exposure has been effected, package 40 is preferably placed in proximity to a corrosion-susceptible material, such as metal surfaces of semiconductor devices. A proximity of between about 0.5 and 30 cm provides a preferred degree of vapor phase corrosion inhibitor deposition upon such corrosion-susceptible materials for protection thereof from corrosion effects. It is also contemplated by the present invention that package 40, for example, may be provided without first barrier layer 56, such that only second barrier layer 52 seals chamber 46 until selectively breached by the user.

Specific embodiments of the present invention are further illustrated by the following examples. Such examples, however, should not be construed as being limiting to the scope of the invention, but rather as particular embodiments representative of the invention.

EXAMPLE 1

An aqueous solution having a 40% by weight concentration of volatile corrosion inhibitor materials was prepared by dissolving the following corrosion inhibitor mixture in water:

| Corrosion Inhibitor Component | Concentration (Weight) |
|---|---|
| Cyclohexyl-ammonium Benzoate | 50% |
| Ammonium Benzoate | 25% |
| Sodium Benzotriazole | 5% |
| Monoethanolammonium Benzoate | 10% |
| Imidazoline Nitrate | 10% |

Open cell foam having a density of about 1.1 to 1.2 pounds per cubic foot is available from Future Foam, Inc. of Council Bluffs, Iowa in sheet form with a thickness of 0.25 inch. An open cell foam roll was immersed in the corrosion inhibitor solution in a roll coating apparatus having a feed speed of 20 ft/min, and was subsequently air dried for 10 minutes at 175° F. The resultant product contained about 60% by weight volatile corrosion inhibitor materials.

EXAMPLE 2

An open cell foam from Future Foam, Inc. having a density of about 1.35 to 1.5 pounds per cubic foot and a thickness of 0.25 inches was immersed in the corrosion inhibitor solution of Example 1 and subsequently dried. The resultant product contained about 35% by weight volatile corrosion inhibitor materials.

EXAMPLE 3

An aqueous solution was prepared containing 40% by weight of volatile corrosion inhibitor materials in the following ratios:

| Corrosion Inhibitor Component | Concentration (Weight) |
|---|---|
| Cyclohexyl-ammonium Benzoate | 70% |
| Benzotriazole | 30% |

The open cell foam material of Example 1 was immersed in the above aqueous solution in the roll coating apparatus and subsequently dried as described above. The resultant product contained about 60% by weight volatile corrosion inhibitor material, and is particularly useful in the corrosion protection of copper and aluminum.

DISCUSSION

The volatile corrosion inhibitor loaded foam was cut to a desired size and enclosed in the inner enclosure barrier as a vapor phase corrosion inhibitor-emitting substrate. The inner enclosure barrier was formed of two sheets of Tyvek® 1059 material available from E.I. du Pont de Nemours & Company, with each sheet having a caliper thickness of 125-175 μm. The respective perimeter portions of each sheet are heat-sealed to one another in a conventional heat-sealing apparatus operating at 110° C.

The combination of the substrate within the inner enclosure barrier was disposed within the outer enclosure barrier that is formed of two sheets of metalized film available from LPS Industries of Moonachie, N.J. under the designation VF42. The metallized film layers were sealed to one another at their respective perimeters through an impulse heat sealing process at the following operating conditions:

Temperature=350° F.

Pressure=26 psi

Time=0.75 sec

The seal between the two film layers of the outer enclosure barrier is preferably gas-tight so as to render the entire boundary gas-impermeable.

The effectiveness of the loaded substrates as packaged within the enclosure barriers as described above was analyzed using Time of Flight Surface Ion Mass Spectroscopy (TOF-SIMS) on copper wafers within a lot box placed between about 0.1 and up to 30 cm from the vapor phase corrosion inhibitor-emitting substrates. In addition, the analysis reviewed the extent to which the corrosion protection characteristic was retained on the respective corrosion-susceptible wafers. Additional testing over a temperature range from −20° C. to +250° C. of a fully treated wafer showed significant disorption beginning at 150° C. The long-term retention of the corrosion inhibition characteristic at ambient conditions is important in applications such as within the semiconductor industry, as corrosion-susceptible wafers may experience varying degrees of moisture and airborne chemical contaminate exposure between processing steps.

Figure 5:
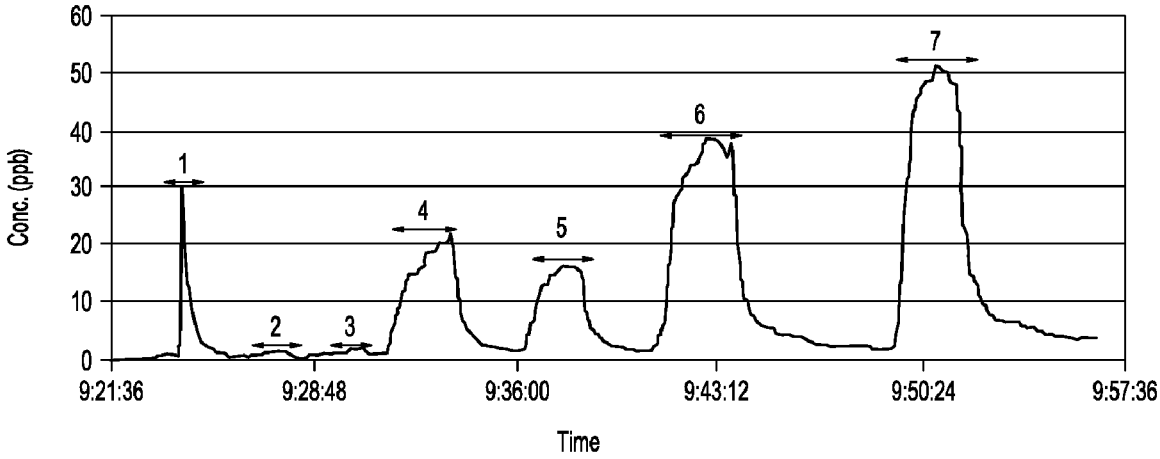
FIG. 5 is a graph of time-to-flight surface ion mass spectroscopy (TOF-SIMS) on copper wafers.

Ambient vapor phase corrosion inhibitor concentration levels were also measured within a closed lot box and clearly showed higher concentrations of vapor phase corrosion inhibitors when the corrosion inhibitor products are stored within a gas-impermeable packaging barrier, as compared to corrosion inhibitor products exposed to ambient environment for extended periods of time prior to use. Effectiveness of the corrosion inhibitor products within the lot box mini-environment has been shown using TOF-SIMS analysis of copper wafers to increase with higher inhibitor concentrations within the lot box, resulting in achieving desired corrosion protection characteristics in a shorter period of time. The results, illustrated in FIG. 5, clearly indicate that the outer gas-permeable packaging barrier maintains the corrosion inhibitor product disposed therewithin at a relatively higher level of effectiveness than those products exposed to the ambient environment for an extended period of time prior to use.

| Sample | Conditions | Maximum Vapor Phase Corrosion Inhibitor Concentration (PPB) |
|---|---|---|
| 1 | 11 VCI-containing substrates in accordance with Example 1 opened from packaging and disposed within a polyethylene bag for about 1 year, tested in polyethylene bag. | 31 |
| 2 | Empty lot box | 0 |
| 3 | 1 VCI-containing substrate in accordance with Example 1, opened from packaging and placed in empty lot box for 1 year prior to testing. | 3 |
| 4 | 1 VCI-containing substrate from group tested in Sample 1; placed and tested in empty lot box. | 22 |
| 5 | 1 VCI-containing substrate in accordance with Example 1, opened from an outer | 16 |

-continued

| Sample | Conditions | Maximum Vapor Phase Corrosion Inhibitor Concentration (PPB) |
|---|---|---|
| | gas-impermeable outer enclosure but still disposed within a gas-permeable, solid particle-impermeable material enclosure and exposed to the ambient environment in this condition for 6 months prior to testing in empty lot box. | |
| 6 | 1 VCI-containing substrate in accordance with Example 1, opened from an outer gas-impermeable outer enclosure but still disposed within a gas-permeable, solid particle-impermeable material enclosure and exposed to the ambient environment in this condition for about 1 month prior to testing in empty lot box. | 38 |
| 7 | 1 VCI-containing substrate in accordance with Example 1, opened from an outer gas-impermeable outer enclosure but still disposed within a gas-permeable, solid particle-impermeable material inner enclosure, and tested immediately in an empty lot box. | 53 |

The invention has been described herein in considerable detail in order to comply with the patent statutes, and to provide those skilled in the art with the information needed to apply the novel principles and to construct and use embodiments of the invention as required. However, it is to be understood that the invention can be carried out by specifically different devices and that various modifications can be accomplished without departing from the scope of the invention itself.

What is claimed is:

1. A method for inhibiting corrosion of corrosion-susceptible material, said method comprising:

(a) providing a corrosion inhibitor package having:

(i) a first enclosure barrier comprising one or more gas-impermeable materials and defining a first enclosed space;

(ii) a second enclosure barrier comprising a gas-permeable, solid particle-impermeable material, said second enclosure barrier being disposed in said first enclosed space and defining a second enclosed space inside of said first enclosed space, said second enclosure barrier having mono-direction emissivity and permitting vapors to pass through said second enclosure barrier from within the second enclosed space; and (iii) a substrate having one or more volatile corrosion inhibitor materials disposed thereon, said substrate being disposed within said second enclosed space;

(b) breaching said first enclosure barrier to thereby render said second enclosed space in gas communication with ambient environment external to said corrosion inhibitor package; and (c) placing said corrosion inhibitor package in proximity to corrosion-susceptible material.

2. A method as in claim 1 wherein the breaching includes removing at least a portion of said first enclosure barrier from said corrosion inhibitor package.

3. A method as in claim 1 wherein said corrosion-susceptible material is metal surfaces of a semiconductor device.

4. A method as in claim 1 wherein said corrosion-susceptible material is metal surfaces of a semiconductor wafer.

5. A method as in claim 1 wherein said corrosion inhibitor package is placed between about 0.1 and 30 cm from said corrosion-susceptible material.

6. A method as in claim 1, including substantially immediately placing said corrosion inhibitor package in proximity to said corrosion-susceptible material upon breach of said first enclosure barrier.

7. A method as in claim 1, wherein said substrate includes an open cell foam divided into a plurality of distinct foam pieces having a mean diameter of between about 0.25 mm and 0.5 mm.

8. A method as in claim 1, wherein said one or more volatile corrosion inhibitor materials are disposed on said substrate with a loading of 35 wt % to 60 wt %.

9. A method as in claim 1, wherein said one or more gas-impermeable materials include a metalized polyethylene terephthalate film including a vapor deposited film of metal.

10. A method as in claim 1, wherein said one or more gas-impermeable materials of said first enclosure barrier include a self-supporting gas-impermeable material defining an annular flange.

11. A method as in claim 10, wherein said one or more gas-impermeable materials of said first enclosure barrier further include a barrier layer secured to the annular flange.

12. A method for inhibiting corrosion of corrosion-susceptible material, said method comprising:

(a) providing a corrosion inhibitor package having:

(i) a first enclosure comprising one or more gas-impermeable materials and defining a first enclosed space;

(ii) a second enclosure defining a second enclosed space within the first enclosed space, the second enclosure having mono-direction emissivity and permitting vapor to pass through the second enclosure from the inside of the second enclosed space; and (iii) a substrate having one or more volatile corrosion inhibitor materials disposed thereon, said substrate being disposed within said first enclosed space;

(b) breaching said enclosure barrier to thereby render said substrate in gas communication with ambient environment external to said enclosure barrier; and (c) placing said substrate in proximity to said corrosion-susceptible material.

13. A method as in claim 12 wherein the breaching includes removing at least a portion of said enclosure barrier from said corrosion inhibitor package.

14. A method as in claim 12 wherein said corrosion-susceptible material is metal surfaces of a semiconductor device.

15. A method as in claim 12 wherein said corrosion-susceptible material is metal surfaces of a semiconductor wafer.

16. A method as in claim 12 wherein said substrate is placed between about 0.5 and 30 cm from said corrosion-susceptible material.

17. A method as in claim 12, including substantially immediately placing said substrate in proximity to said corrosion-susceptible material upon breach of said enclosure barrier.

18. A method as in claim 12, wherein said substrate includes an open cell foam divided into a plurality of distinct foam pieces having a mean diameter of between about 0.25 mm and 0.5 mm.

19. A method as in claim 12, wherein said one or more volatile corrosion inhibitor materials are disposed on said substrate with a loading of 35 wt % to 60 wt %.

20. A method as in claim 12, wherein said one or more gas-impermeable materials include a metalized polyethylene terephthalate film including a vapor deposited film of metal.

21. A method as in claim 12, wherein said one or more gas-impermeable materials of said first enclosure include a self-supporting gas-impermeable material defining an annular flange.

22. A method as in claim 21, wherein said one or more of said gas-impermeable materials first enclosure further include a barrier layer secured to the annular flange.

23. A method for inhibiting corrosion of corrosion-susceptible material, said method comprising:

(a) providing a corrosion inhibitor package having:

(i) a first enclosure barrier defining a first enclosed space and comprising a gas-impermeable material including a metalized polyethylene terephthalate film including vapor deposited metal;

(ii) a second enclosure barrier disposed within the first enclosed space and defining a second enclosed space, the second enclosure barrier being mono-direction emissive and permitting vapors to pass through said second enclosure barrier from within the second enclosed space; and (iii) a substrate having one or more volatile corrosion inhibitor materials disposed thereon, said substrate being disposed within said second enclosed space;

(b) breaching said first enclosure barrier to thereby render said second enclosed space in gas communication with ambient environment external to said corrosion inhibitor package; and (c) placing said corrosion inhibitor package in proximity to corrosion-susceptible material.

24. A method as in claim 23, wherein the first enclosure barrier further comprises a self-supporting barrier material defining an annular flange, the metalized polyethylene terephthalate film secured to the annular flange.

25. A method as in claim 23, wherein said substrate includes an open cell foam divided into a plurality of distinct foam pieces having a mean diameter of between about 0.25 mm and 0.5 mm.

26. A method as in claim 23, wherein said one or more volatile corrosion inhibitor materials are disposed on said substrate with a loading of 35 wt % to 60 wt %.

* * * * *